US006726017B2

(12) United States Patent
Maresh et al.

(10) Patent No.: US 6,726,017 B2
(45) Date of Patent: Apr. 27, 2004

(54) PACKAGING SYSTEM FOR A COMPONENT INCLUDING A COMPRESSIVE AND SHOCK-ABSORBENT PACKING INSERT

(75) Inventors: Mark Edmund Maresh, Wake Forest, NC (US); Eric Allen Stegner, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 117 days.

(21) Appl. No.: 09/981,186

(22) Filed: Oct. 17, 2001

(65) Prior Publication Data

US 2003/0070959 A1 Apr. 17, 2003

(51) Int. Cl.[7] ..... B65D 5/50; B65D 81/02
(52) U.S. Cl. ..... 206/723; 206/594
(58) Field of Search ..... 206/701, 721, 206/722, 723, 591, 592, 593, 594, 784

(56) References Cited

U.S. PATENT DOCUMENTS

| | | | | |
|---|---|---|---|---|
| 1,119,089 A | | 12/1914 | McMenamin | |
| 1,522,902 A | | 1/1925 | Oppenheim | |
| 1,655,071 A | | 1/1928 | Oppenheim | |
| 1,682,410 A | | 8/1928 | Oppenheim | |
| 1,691,736 A | | 11/1928 | Oppenheim | |
| 3,669,336 A | * | 6/1972 | Robinson | 206/591 |
| 3,934,720 A | | 1/1976 | Kratochvil, Jr. | |
| 4,171,745 A | | 10/1979 | Zicko | |
| 4,707,414 A | * | 11/1987 | Long et al. | 428/511 |
| 5,197,606 A | | 3/1993 | Lancaster | |
| 5,322,168 A | | 6/1994 | Kataoka | |
| 5,341,934 A | | 8/1994 | Hsu | |
| 5,439,114 A | * | 8/1995 | Lingle et al. | 206/586 |
| 5,462,171 A | * | 10/1995 | Moog et al. | 206/592 |
| 5,823,352 A | * | 10/1998 | Mena et al. | 206/721 |

FOREIGN PATENT DOCUMENTS

| | | |
|---|---|---|
| JP | 11130053 | 10/1997 |

* cited by examiner

*Primary Examiner*—Jacob K. Ackun
(74) *Attorney, Agent, or Firm*—J. Bruce Schelkopf; Sawyer Law Group

(57) ABSTRACT

A packaging system for a component is disclosed. The packaging system comprises a box and a carrier within the box. The packaging system also includes a compressible and shock-absorbent packing insert, wherein the packing insert is placed above a component after nesting the component within the carrier. Accordingly, the packaging system in accordance with the present invention employs a low cost, environment-friendly material to protect fragile components from any potential damage that can be caused during the shipping process.

20 Claims, 7 Drawing Sheets

PACKAGING SYSTEM FOR A COMPONENT INCLUDING A COMPRESSIVE AND SHOCK-ABSORBENT PACKING INSERT

FIELD OF THE INVENTION

The present invention relates generally to packaging systems and more specifically to a packing insert for use in a packaging system for fragile components.

BACKGROUND OF THE INVENTION

Previous approaches to shipping fragile components (i.e., hard drives) have typically utilized substances such as resilient foam, as well as adhesives and other non-recyclable materials when packaging such components. Typically in the case of hard drives, the maximum force that can be applied to all axes in a conventional hard drive is approximately 70 Gs.

FIG. 1 is an exploded view of a typical packaging system 10 for a hard drive. The system includes a polyurethane bottom cushion 12, a polyurethane middle cushion 14, a polyurethane top cushion 16 and a corrugated tray 18, all of which fit into a corrugated carton 10. Utilizing this approach, the hard drive to be shipped (not shown) is inserted between the polyurethane top cushion 16 and the polyurethane bottom cushion 12, through the polyurethane middle cushion 14. Although the system 10 works acceptably to protect the hard drive below the 70 G fragility level, it has two major drawbacks. A first major drawback to this system is the high cost of the polyurethane material. A second major drawback is that polyurethane is not biodegradable and thus not environment-friendly.

Accordingly, what is needed is a system and method which is lower in cost, utilizes environmentally safe and recyclable materials, and yet safely protects fragile components from any potential damage that can be caused during the shipping process. The present invention addresses such a need.

SUMMARY OF THE INVENTION

A packaging system for a component is disclosed. The packaging system comprises a box and a carrier within the box. The packaging system also includes a compressible and shock-absorbent packing insert, wherein the packing insert is placed above a component after nesting the component within the carrier.

Accordingly, the packaging system in accordance with the present invention employs low cost, environment-friendly material to protect fragile components from any potential damage that can be caused during the shipping process.

DETAILED DESCRIPTION

The present invention relates generally to packaging systems and more specifically to a packing insert for use in a packaging system for fragile components. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown, but is to be accorded the widest scope consistent with the principles and features described herein.

The preferred embodiment of the present invention is a corrugated packing insert for protecting a highly fragile component (i.e., hard disk drive) during shipment. Accordingly, the packing insert in accordance with the present invention employs a low cost, environment-friendly material (i.e. corrugated material) to protect fragile components from any potential damage that can be caused during the shipping process.

Figure 1:
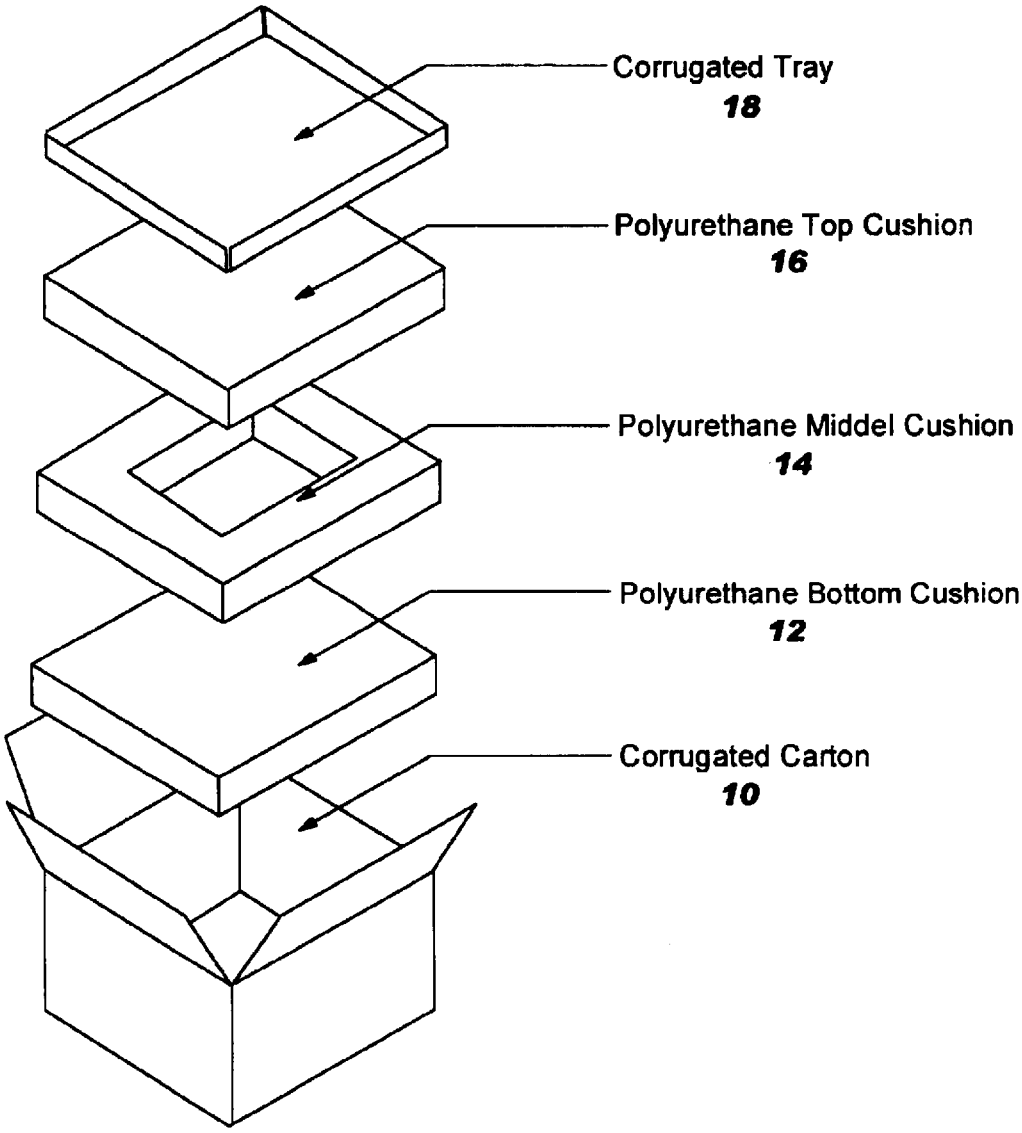
FIG. 1 Prior Art
FIG. 1 is an exploded view of a conventional packaging system for fragile components.
Figure 2:
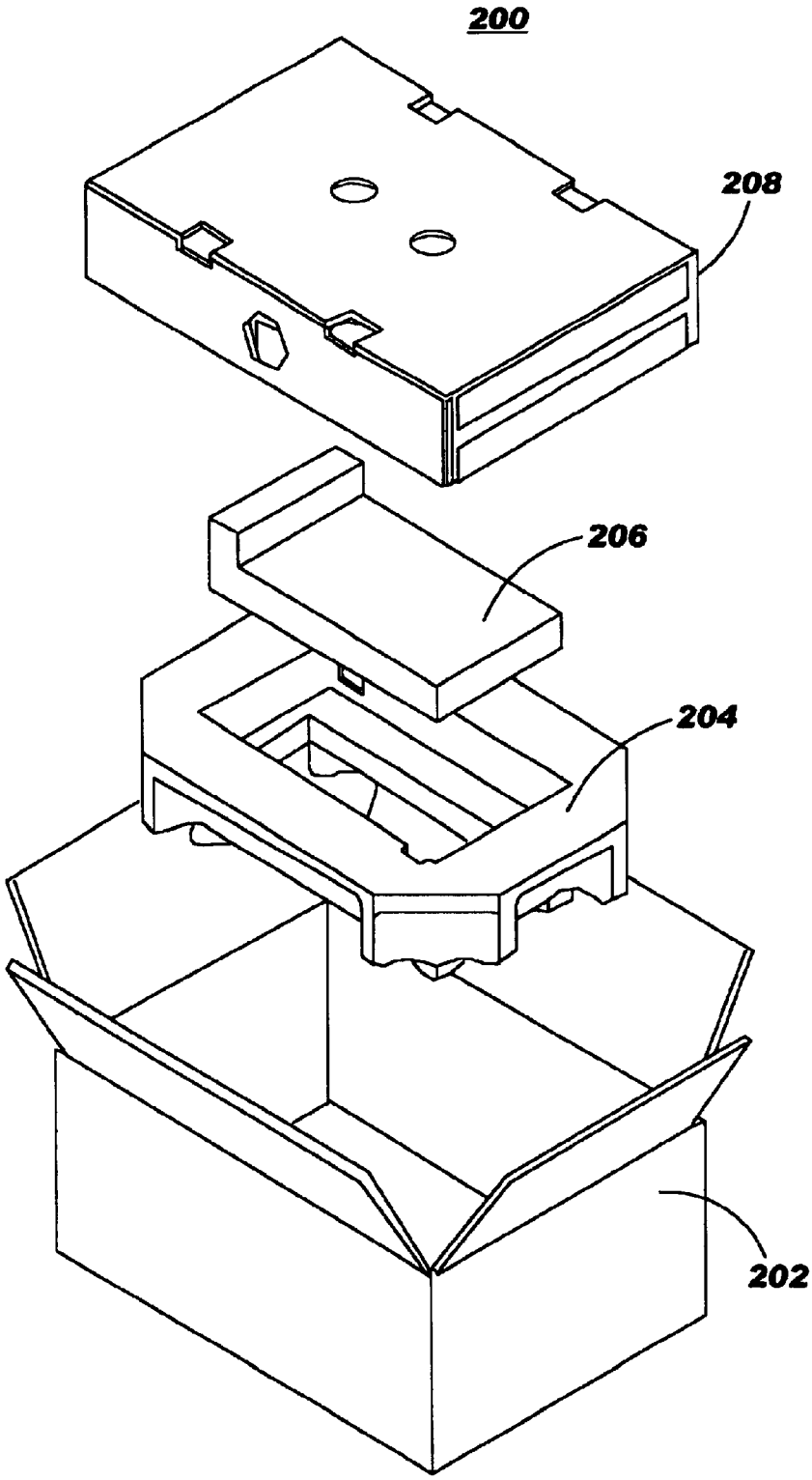
FIG. 2 is an exploded view of a packaging system in accordance with the present invention.

For a more detailed description of the present invention, refer now to the following discussion in conjunction with the accompanying figures. FIG. 2 is an exploded view of a packaging system 200 in accordance with the present invention. The system 200 comprises a box 202, a carrier 204, and a compressible and shock-resistant packing insert 208. The packing insert 208 is placed above a component 206 after nesting the component 206 within the carrier 204. The carrier 204, the component 206, and the packing insert 208 are then placed in the box 202. The carrier 204 is preferably made of plastic.

The packaging insert 208 is preferably made of a corrugated paper material. The corrugated paper material is preferable due to the compressive properties of the material. Specifically, the corrugated paper material has a tendency to flex when it is compressed during shock and vibration and therefore functions in a manner similar to that of a plastic foam typically utilized in conventional packaging systems. The corrugated paper material is also biodegradable and thus environment-friendly.

Although the present invention has been described in terms of being made of a corrugated paper material, one of ordinary skill in the art will readily recognize that the present invention could be made with any of a variety of low cost, environmentally friendly materials while remaining within the spirit and scope of the present invention. The key feature of the packaging insert is that the insert is flexible and shock-absorbent.

Figure 3:
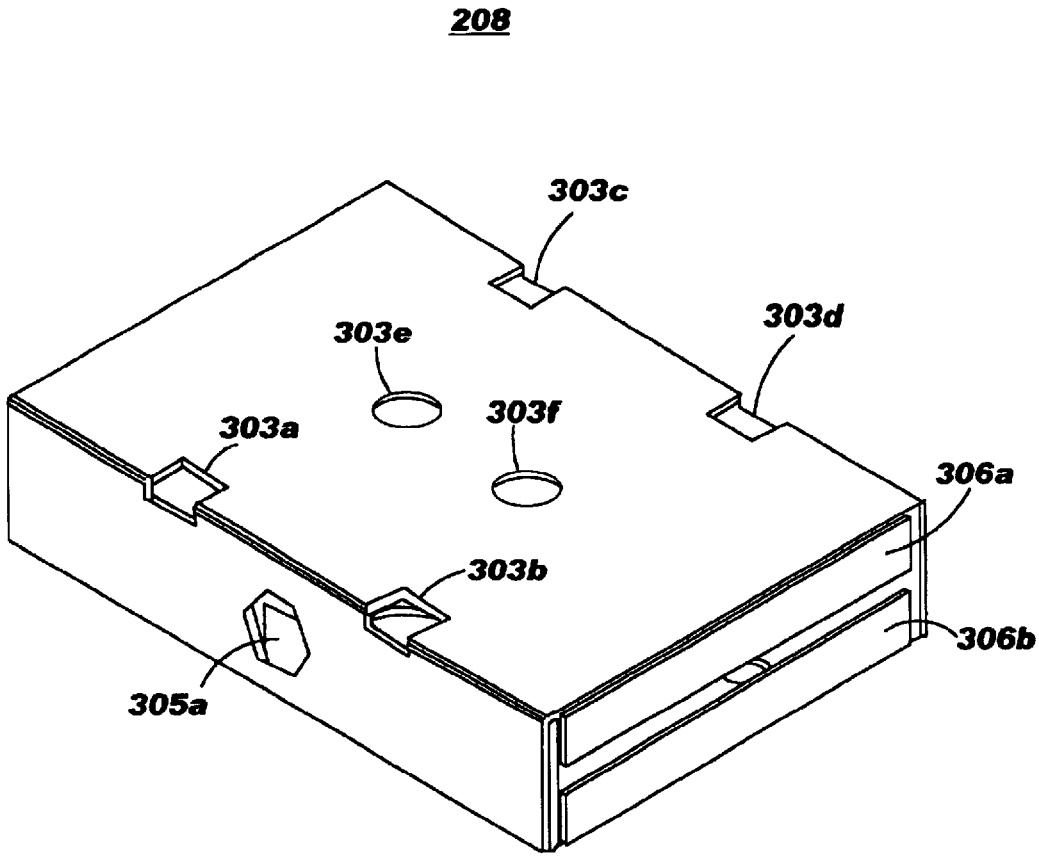
FIG. 3 illustrates the completely assembled corrugated packing insert.
Figure 4:
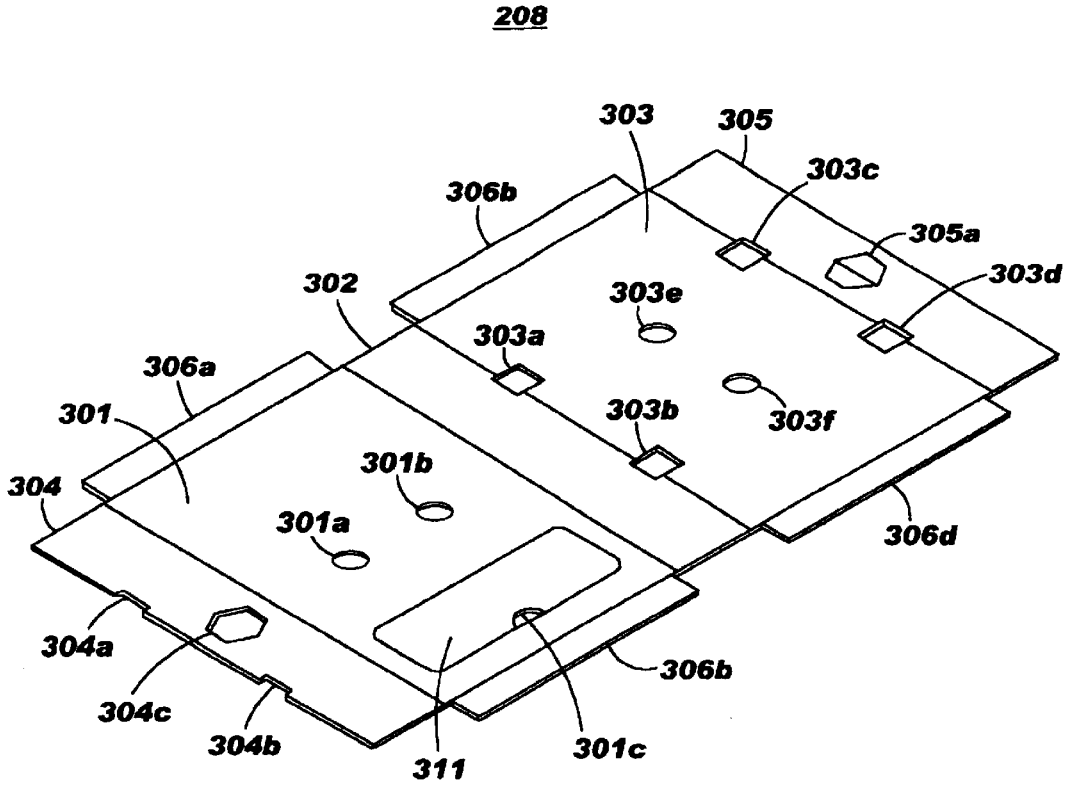
FIG. 4 is a detailed illustration of the packing insert completely unfolded.

FIG. 3 illustrates the completely assembled corrugated packing insert 208. FIG. 4 is a detailed illustration of the packing insert 208 completely unfolded. The insert 208 comprises a bottom wall 301 wherein the bottom wall includes two finger holes 301*a* and 301*b* and a half-moon finger hole 301*c*; a retaining portion 302; and a pop-out section 311 to accommodate a high bezel hard drive. The insert 208 further includes a top wall 303, wherein the top wall 303 includes a plurality of cutouts 303*a*–303*d* and two finger holes 303*e* and 303*f*; and a first side wall flap 304. The first side wall flap includes two cutouts 304*a* and 304*b* which create flexibility to absorb shock and an aperture 304*c*; and a second side wall flap 305. The second side wall flap 305 includes a locking tab 305*a*. The insert 208 also preferably includes a plurality of extendable flaps 306*a*–306*d*.

The top wall 303 is foldably coupled to the bottom wall 301 via the retaining portion 302. This allows the top wall 303 to be folded over the bottom wall 301. The first side wall flap 304 is coupled to the bottom wall 301 along the side edge of the bottom wall 301 opposite the retaining portion 302, and the second side wall flap 305 is coupled to the top wall 303 along the side edge of the top wall 303 opposite the retaining portion 302. The plurality of extendable flaps 306*a–d* comprises first and second flaps 306*a* and 306*b* that are hingedly coupled to the bottom wall 301 along the top and bottom edges of the bottom wall 301, respectively, and third and fourth flaps 306*c* and 306*d* that are hingedly coupled to the top wall 303 along the top and bottom edges of the top wall 303, respectively.

Figure 5:
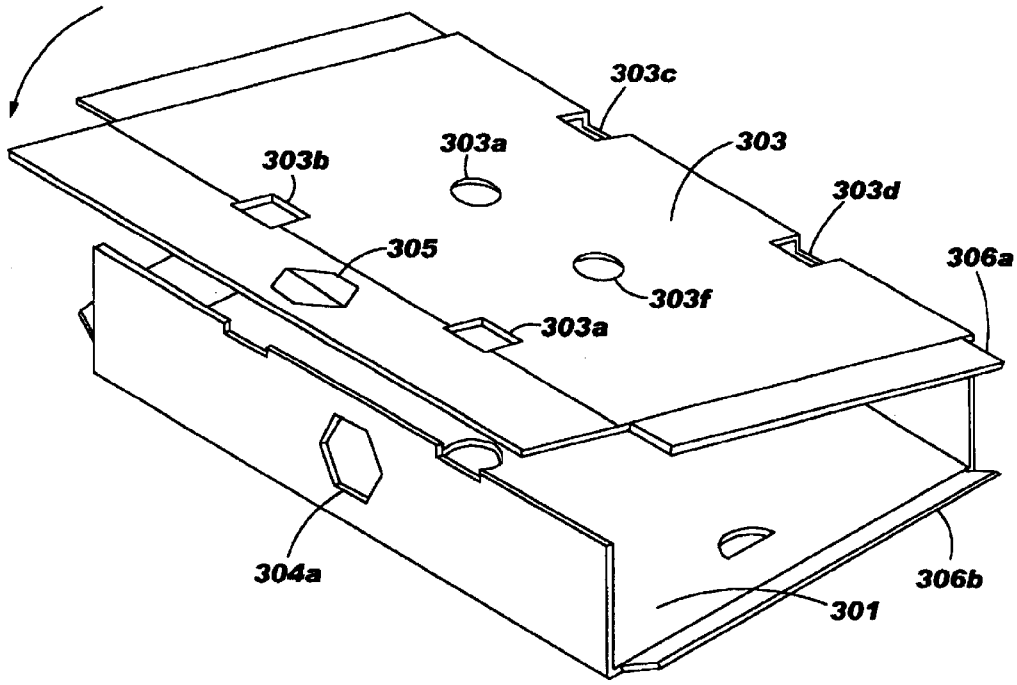
FIG. 5 illustrates the top wall being folded over the bottom wall of the insert.
Figure 6:
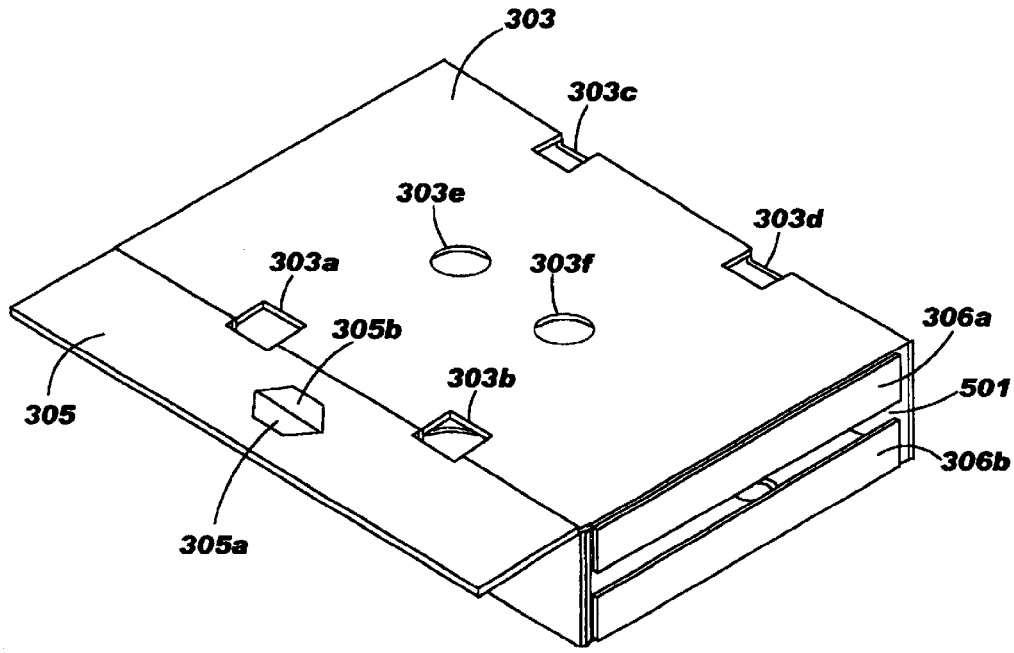
FIG. 6 illustrates the extendable flaps being folded inwardly from the top wall and the bottom wall.

FIG. 5 illustrates the top wall 303 being folded over the bottom wall 301 of the insert 208. FIG. 6 illustrates the extendable flaps 306*b* and 306*d* being folded inwardly from the top wall 303 and the bottom wall 301 to create stiffness and rigidity along the edge of the packing insert 208, thereby preventing the packing insert 208 from collapsing. Furthermore, a space 500 is created between the extendable flaps 306*b* and 306*d* to allow for movement of the packing insert 208 during compression of the packing insert 208, thereby resulting in a deflection of the amount of shock being transmitted to the hard disk drive.

Once the extendable flaps 306*b* and 306*d* are folded inwardly, the first side wall flap 305 is folded downward and connected with the second side wall flap 304, whereby the locking tab 305*a* is interlocked with the aperture 304*c* to lock the first and second side wall flaps 304, 305 together.

Figure 7:
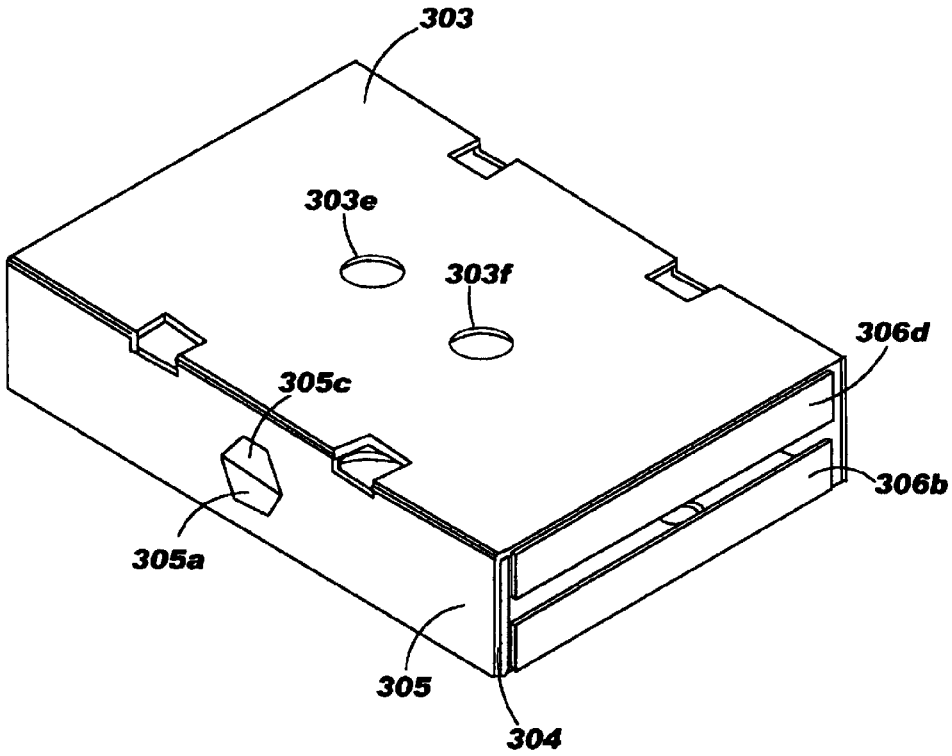
FIG. 7 illustrates the insert prior to being locked.

FIG. 7 illustrates the insert prior to being locked. The locking tab 305*a* and the aperture 304*c* make up a locking tab system. Accordingly, the locking tab 305*a*, once interlocked with aperture 304*c*, provides a lock that keeps the packing insert 208 from opening back up. This allows the packing insert to be easily assembled without the utilization of glue or expensive mechanical fasteners. The packing insert 208 also includes finger holes 303*e* and 303*f* in the top wall 303. This allows a packer to easily remove the packing insert 208 from a shipping pack, insert the drive or components to be shipped, and then replace the packing insert 208. (Not shown are the finger holes 301*a* and 301*b* in the bottom wall 301 which have the same functionality as finger holes 303*e* and 303*f*.) Accordingly, the present invention decreases manufacturing assembly time, thereby resulting in increased manufacturing efficiency.

The packing insert 208 is reversible to accommodate various drives with various weights. Specifically, one side of the invention has a pop out section to accommodate large bezel drives. Additionally, this design allows for all contents associated with the component to be placed inside the corrugated packaging insert 208 thereby conserving space within the shipping pack.

Although the present invention has been described in terms of packaging a hard disk drive, one of ordinary skill in the art will readily recognize that it might also be used to package other kinds of fragile components which need to be protected from any potential damage that could be caused during the shipping process.

A typical hard drive has a fragility level of 70 Gs on all axes. The packaging design in accordance with the present invention results in shock readings below 30 Gs, on repeated drops during testing, thereby protecting the product well beyond the hard drive's critical fragility level. Any other component with a similar fragility level could also be safely shipped using the corrugated insert in accordance with the present invention.

The present invention is a corrugated packing insert for protecting an article of manufacture during shipment. Accordingly, the packing insert in accordance with the present invention employs a low cost, environment-friendly material (i.e. corrugated paper material) to protect fragile components from any potential damage that can be caused during the shipping process.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A packaging system for a component, the packaging system comprising:

a box;

a carrier within the box; and a compressible and shock-absorbent packing insert, wherein the packing insert is placed above the component after nesting the component within the carrier, wherein the packing insert comprises:

a bottom wall foldably coupled to a first edge of a retaining portion;

a top wall foldably coupled to a second edge of the retaining portion opposite to the first edge;

a plurality of non-overlapping extendable flaps foldably coupled to the bottom and top walls; and a gap between the extendable flap coupled to the bottom wall and the extendable flap coupled to the top wall when the packing insert is folded at the first and second edge of the retaining portion.

2. The packaging system of claim 1 wherein the packing insert comprises a corrugated paper material that is biodegradable.

3. The packaging system of claim 2 wherein the packing insert further comprises first and second side wall flaps respectively coupled to the bottom and top walls.

4. The packaging system of claim 3 wherein the packing insert further comprises a locking tab system for connecting the first and second side wall flaps in an interlocking relationship.

5. The packaging system of claim 4 wherein the locking tab system comprises an aperture located in the first side wall flap and a locking tab located on the second side wall flap wherein the locking tab is capable of being interlocked with the aperture to lock the first and second side wall flaps together.

6. The packaging system of claim 5 wherein the top and bottom walls include at least one finger hole.

7. The packaging system of claim 1 wherein the top wall includes a plurality of cutouts over the edges of the top wall to enhance the flexing capability of the packing insert.

8. The packaging system of claim 7 wherein the plurality of extendable flaps comprise first and second flaps respectively extending along the top and bottom edges of the bottom wall and third and fourth flaps respectively extending along the top and bottom edges of the top wall.

9. A packing insert for use in a packaging system comprising:

a bottom wall foldably coupled to a first edge of a retaining portion;

a top wall foldably coupled to a second edge of the retaining portion opposite to the first edge;

first and second side wall flaps respectively coupled to the bottom and top walls, the first and second side wall flaps capable of being connected in an interlocking relationship;

a plurality of non-overlapping extendable flaps foldably coupled to the bottom and top walls, wherein the packing insert is compressible and shock-absorbent; and a gap between the extendable flap coupled to the bottom wall and the extendable flap coupled to the top wall when the packing insert is folded at the first and second edge of the retaining portion.

10. The packing insert of claim 9 further comprising a locking tab system for connecting the first and second side wall flaps in an interlocking relationship.

11. The packing insert of claim 10 wherein the locking tab system comprises an aperture located in the first side wall flap and a locking tab located on the second side wall flap wherein the locking tab is capable of being interlocked with the aperture to lock the first and second side wall flaps together.

12. The packing insert of claim 11 wherein the top and bottom walls include at least one finger hole.

13. The packing insert of claim 9 wherein the top wall includes a plurality of cutouts over the edges of the top wall to enhance the flexing capability of the packing insert.

14. The packing insert of claim 13 wherein the plurality of extendable flaps comprise first and second flaps respectively extending along the top and bottom edges of the bottom wall and third and fourth flaps respectively extending along the top and bottom edges of the top wall.

15. The packing insert of claim 14 wherein the packing insert is comprised of a corrugated paper material.

16. A packing insert for use in a packaging system comprising:

a bottom wall foldably coupled to a first edge of a retaining portion, the bottom wall comprising at least one finger hole;

a top wall foldably coupled to a second edge of the retaining portion opposite to the first edge, the top wall comprising at least one finger hole;

first and second side wall flaps respectively coupled to the bottom and top walls, the first and second side wall flaps capable of being connected in an interlocking relationship via a locking tab system, wherein the locking tab system comprises an aperture located in the first side wall flap and a locking tab located on the second side wall flap wherein the locking tab is capable of being interlocked with the aperture to lock the first and second side wall flaps together;

a plurality of non-overlapping extendable flaps foldably coupled to the top and bottom walls, wherein the packing insert is compressible and shock-absorbent; and a gap between the extendable flap coupled to the bottom wall and the extendable flap coupled to the top wall when the packing insert is folded at the first and second edge of the retaining portion.

17. The packing insert of claim 16 wherein the top wall includes a plurality of cutouts over the edges of the top wall to enhance the flexing capability of the packing insert.

18. The packing insert of claim 17 wherein the plurality of extendable flaps comprise first and second flaps respectively extending along the top and bottom edges of the bottom wall and third and fourth flaps respectively extending along the top and bottom edges of the top wall.

19. The packing insert of claim 18 wherein the packing insert is comprised of a corrugated paper material.

20. A packing insert for use in a packaging system comprising:

a bottom wall foldably coupled to a first edge of a retaining portion, the bottom wall comprising at least one finger hole;

a top wall foldably coupled to a second edge of the retaining portion opposite to the first edge, the top wall comprising at least one finger hole and a plurality of cutouts to enhance the flexing capability of the packing insert;

first and second side wall flaps respectively coupled to the bottom and top walls, the first and second side wall flaps capable of being connected in an interlocking relationship via a locking tab system, wherein the locking tab system comprises an aperture located in the first side wall flap and a locking tab located on the second side wall flap wherein the locking tab is capable of being interlocked with the aperture to lock the first and second side wall flaps together;

a plurality of non-overlapping extendable flaps foldably coupled to the top and bottom walls, wherein the plurality of extendable flaps comprise first and second flaps respectively extending along the top and bottom edges of the bottom wall and third and fourth flaps respectively extending along the top and bottom edges of the top wall, wherein the packing insert is compressible and shock-absorbent and is made of a corrugated paper material; and a gap between the extendable flap coupled to the bottom wall and the extendable flag coupled to the top wall when the packing insert is folded at the first and second edge of the retaining portion.

* * * * *